US007943002B2

(12) United States Patent
Lu

(10) Patent No.: US 7,943,002 B2
(45) Date of Patent: May 17, 2011

(54) TOOL AND METHOD FOR PACKAGING LENS MODULE

(75) Inventor: Hsin-Chieh Lu, Kaohsiung (TW)

(73) Assignee: Advanced Semiconductor Engineering, Inc. (TW)

( * ) Notice: Subject to any disclaimer, the term of this patent is extended or adjusted under 35 U.S.C. 154(b) by 274 days.

(21) Appl. No.: 12/357,593

(22) Filed: Jan. 22, 2009

(65) Prior Publication Data

US 2009/0194227 A1 Aug. 6, 2009

(30) Foreign Application Priority Data

Feb. 1, 2008 (TW) ..... 97104038 A

(51) Int. Cl.
*B29C 65/00* (2006.01)

(52) U.S. Cl. ..... 156/297; 156/60; 156/64; 156/228; 156/230; 156/232; 156/234; 156/290; 156/298; 156/299; 156/303.1; 156/349; 156/350; 156/378; 156/379; 156/580

(58) Field of Classification Search ..... 156/60, 156/64, 228, 230, 232, 234, 290, 297, 298, 156/299, 303.1, 349, 350, 378, 379, 580
See application file for complete search history.

(56) References Cited

U.S. PATENT DOCUMENTS

| | | | | |
|---|---|---|---|---|
| 7,166,907 | B2 * | 1/2007 | Onishi et al. | 257/680 |
| 2006/0084254 | A1 * | 4/2006 | Attarwala | 438/584 |
| 2008/0121784 | A1 * | 5/2008 | Chang et al. | 250/208.1 |

FOREIGN PATENT DOCUMENTS

CN 2935188 Y 8/2007

* cited by examiner

*Primary Examiner* — Kat Wyrozebski
*Assistant Examiner* — Joshel Rivera
(74) *Attorney, Agent, or Firm* — Bacon & Thomas, PLLC

(57) ABSTRACT

A tool and a method for packaging lens module are provided. The method for packaging lens module includes the following steps. Firstly, a carrier having at least one cavity is provided. Next, a holder is disposed in the cavity. Then, a die is disposed on a surface of a substrate. After that, the substrate is inversely placed on the carrier, wherein the surface where the die is disposed faces the carrier, and the die corresponds to the holder. Then, a cover plate covers the carrier and the substrate, such that the substrate is fixed on the holder.

8 Claims, 8 Drawing Sheets

TOOL AND METHOD FOR PACKAGING LENS MODULE

This application claims the benefit of Taiwan application Serial No. 97104038, filed Feb. 1, 2008, the subject matter of which is incorporated herein by reference.

BACKGROUND OF THE INVENTION

1. Field of the Invention

The invention relates in general to a tool and a method for packaging lens module, and more particularly to a tool and a method for packaging lens module capable of fixing several holders on a substrate concurrently.

2. Description of the Related Art

Referring to FIG. 1, the packaging process of a conventional lens module is shown. Conventional packaging structure for lens module includes a substrate 10, several chips 12 and a holder 14. In the packaging process, the chips 12 are placed on the substrate 10 first, and several holders 14 and the substrate 10 are adhered by an adhesive glue 16 next. In the step of adhering the holder 14 and the substrate 10, the holders 14 need to be adhered with the substrate 10 one by one, hence taking a longer time for adhering.

However, in the step of adhering the holder 14 onto the substrate 10, as the sensing areas on the chips 12 of the substrate 10 faces upwards, the sensing area is thus susceptible to be alighted by dust. As the chips 12 are exposed outside and the adhering time is too long, the external dust 20 may easily alight on the chips 12.

As digital camera has a large volume of pixels, any tiny objects alighted on the lens will result in a shadow in the picture, severely deteriorating photo quality. Therefore, how to provide a method for packaging lens module capable of preventing dust and shortening packaging time has become an important direction of research and development.

SUMMARY OF THE INVENTION

The invention is directed to a tool and a method for packaging lens module. The tool makes the substrate capable of installing several holders concurrently. Furthermore, the holder is fixed on the substrate with the substrate being inversely placed, hence avoiding dust falling into the die sensing area.

According to a first aspect of the present invention, a method for packaging lens module is provided. The method for packaging lens module includes the following steps. Firstly, a carrier having at least one cavity is provided. Next, a holder is disposed in the cavity. Then, a die is disposed on a surface of a substrate. After that, the substrate is inversely placed on the carrier, wherein the surface where the die is disposed faces the carrier, and the die corresponds to the holder. Then, a cover plate covers the carrier and the substrate, such that the substrate is fixed on the holder.

According to a second aspect of the present invention, a tool for packaging lens module is provided. The tool includes a carrier and a cover plate. The carrier has at least one cavity for receiving a holder. The carrier is covered by the cover plate, and there is an accommodation space existing between the carrier and the cover plate for receiving a substrate, wherein the substrate is inversely placed on the carrier. A surface of the substrate where a die is disposed faces the carrier.

The invention will become apparent from the following detailed description of the preferred but non-limiting embodiments. The following description is made with reference to the accompanying drawings.

DETAILED DESCRIPTION OF THE INVENTION

First Embodiment

Figure 1:
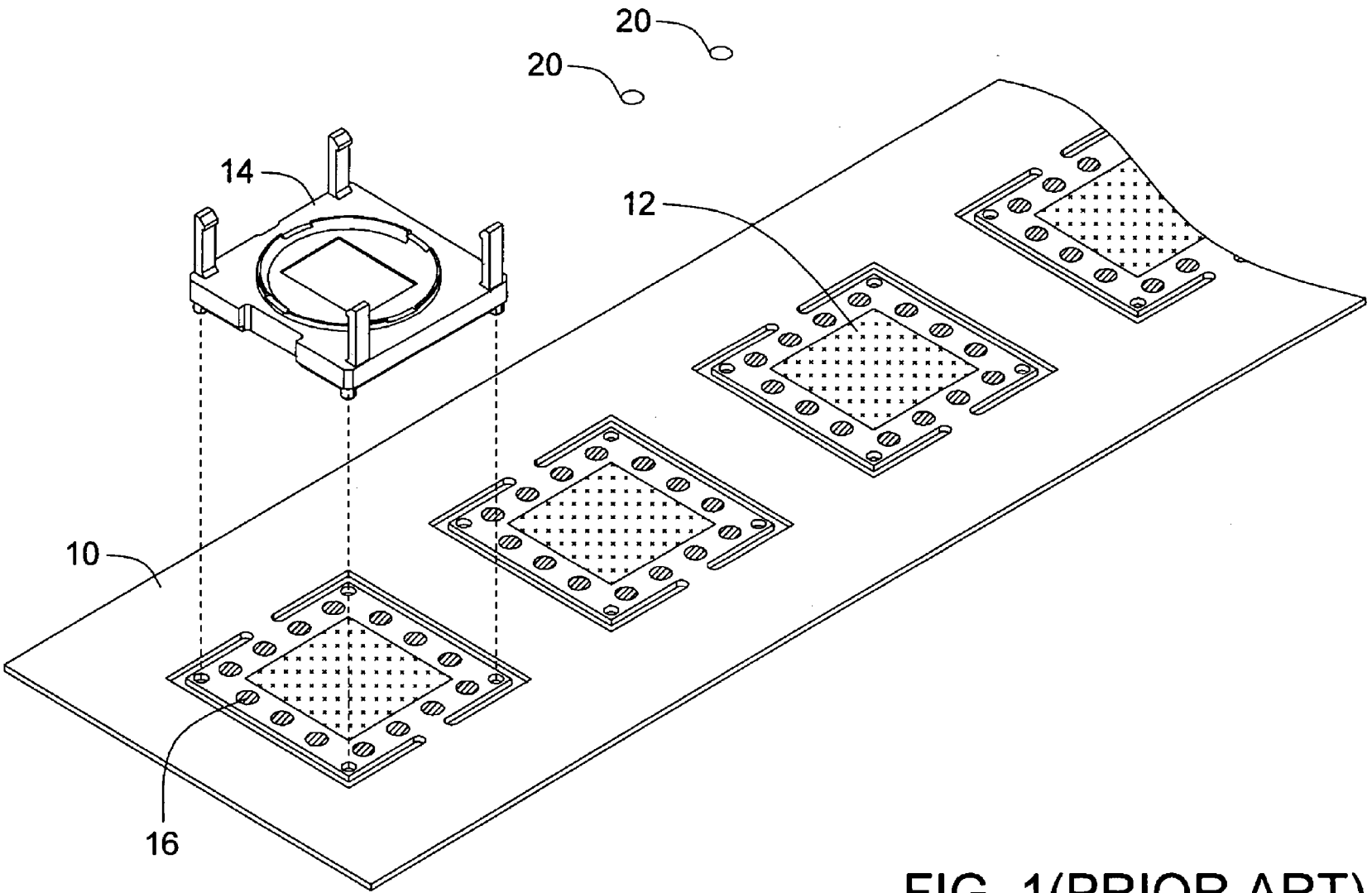
FIG. 1(PRIOR ART)
FIG. 1 shows the packaging process of a conventional lens module.
Figure 2:
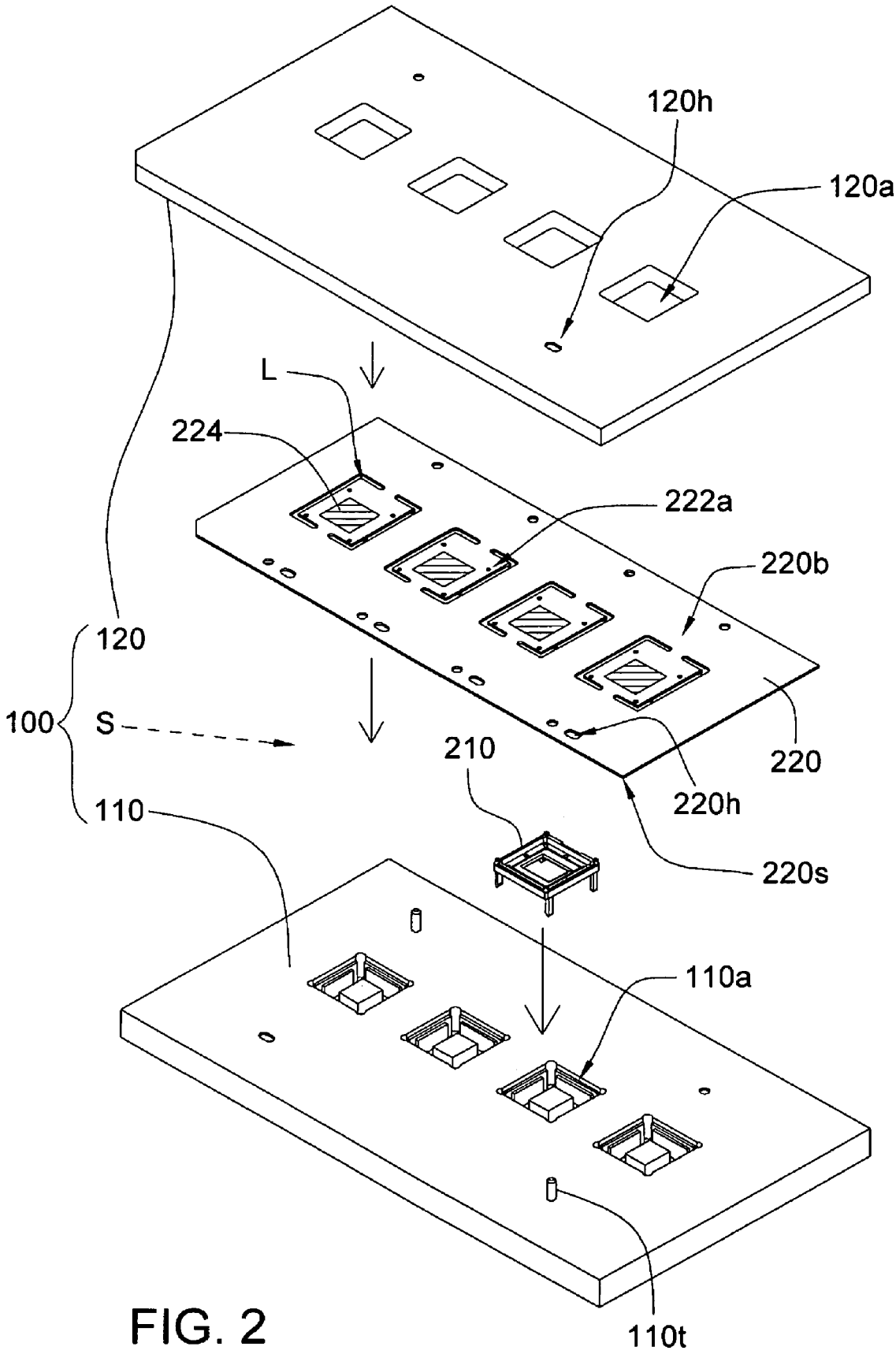
FIG. 2 shows a method for packaging lens module according to a first embodiment of the invention.

Referring to FIG. 2, a method for packaging lens module according to a first embodiment of the invention is shown. The tool 100 for packaging lens module includes a carrier 110 and a cover plate 120. The carrier 110 has at least one cavity 110*a* for receiving a holder 210. The cover plate 120 covers the carrier 110. There is an accommodation space S existing between the carrier 110 and the cover plate 120 for receiving a substrate 220. As the accommodation space S is disposed between the carrier 110 and the cover plate 120, the space between the carrier 110 and the cover plate 120 is marked as the accommodation space S in FIG. 2. The substrate 220 is inversely placed on the carrier 110. A die 222 (shown in FIG. 3) is disposed on a surface of 220*s* of the substrate 220. The surface 220*s* faces the carrier 110. Due to the angle of illustration, the die 222 is not illustrated in FIG. 2 but is illustrated in FIG. 3.

Again, referring to FIG. 2. In the present embodiment of the invention, the carrier 110 has several cavities 110*a*, the substrate 220 has several dies 222 (shown in FIG. 3), and the number of the cavities 110*a* of the carrier 110 is preferably the same with the number of the dies 222. Only one holder 210 is illustrated in the drawing. However, in practical application, the number of the holder 210 is the same with the number of the die 222. Moreover, the number of the cavities 110*a* of the carrier 110 and the number of the dies 222 of the substrate 220 can be adjusted to fit actual needs, and the number of the holder 210 is determined according to the number of the die 222.

Figure 3:
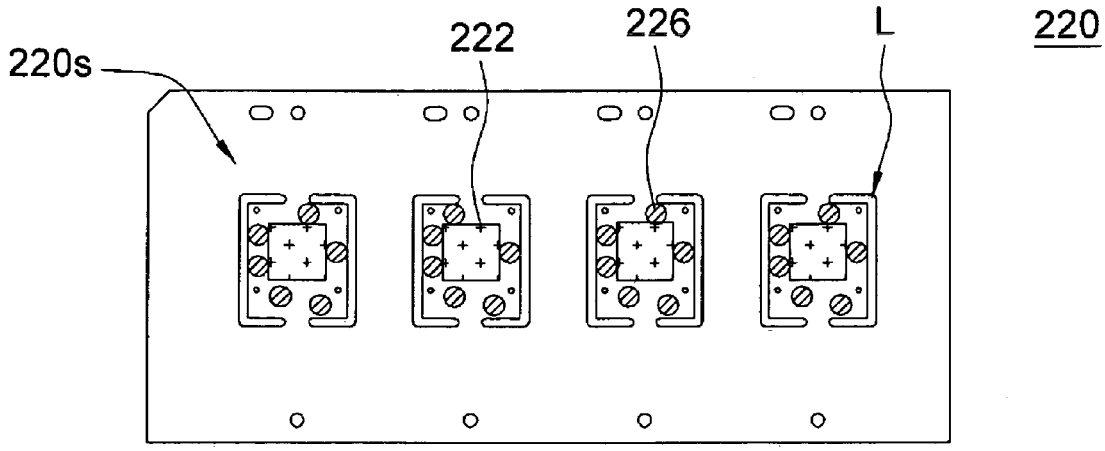
FIG. 3 shows a surface of a substrate of FIG. 2.

Referring to both FIG. 2 and FIG. 3. FIG. 3 shows a surface of the substrate of FIG. 2. The substrate 220 preferably has a cutting line L surrounding the element installation region 224. Likewise, the cutting line L also surrounds the die 222 disposed on the surface 220*s* of the substrate 220. In FIG. 3, as a part of the cutting line L is already hollowed, after the lens module is packaged, several lens modules can be separated from the substrate 220 by cutting the un-hollowed part of the cutting line L. In FIG. 2 of the present embodiment of the invention, a back surface 220*b* of the substrate 220 has at least one element installation region 224. At least one electronic element is disposed within the element installation region 224. The cutting line L surrounds the element installation region 224. As indicated in FIG. 2 and FIG. 3, the die 222 and the element installation region 224 are correspondingly disposed at two sides of the substrate 220.

Again, referring to FIG. 2. The cover plate 120 preferably has several openings 120*a*. The openings 120*a* correspond to the element installation region 224, wherein the openings 120*a* are slightly larger than the element installation region 224 but slightly smaller than the area surrounded by the cutting line L. As the opening 120*a* is slightly larger than the element installation region 224, the cover plate 120 will not press and damage the electronic element disposed in the element installation region 224. As the opening 120*a* is slightly smaller than the cutting line L, the cover plate 120 still can press the substrate 220 within the cutting line L.

Figure 4:
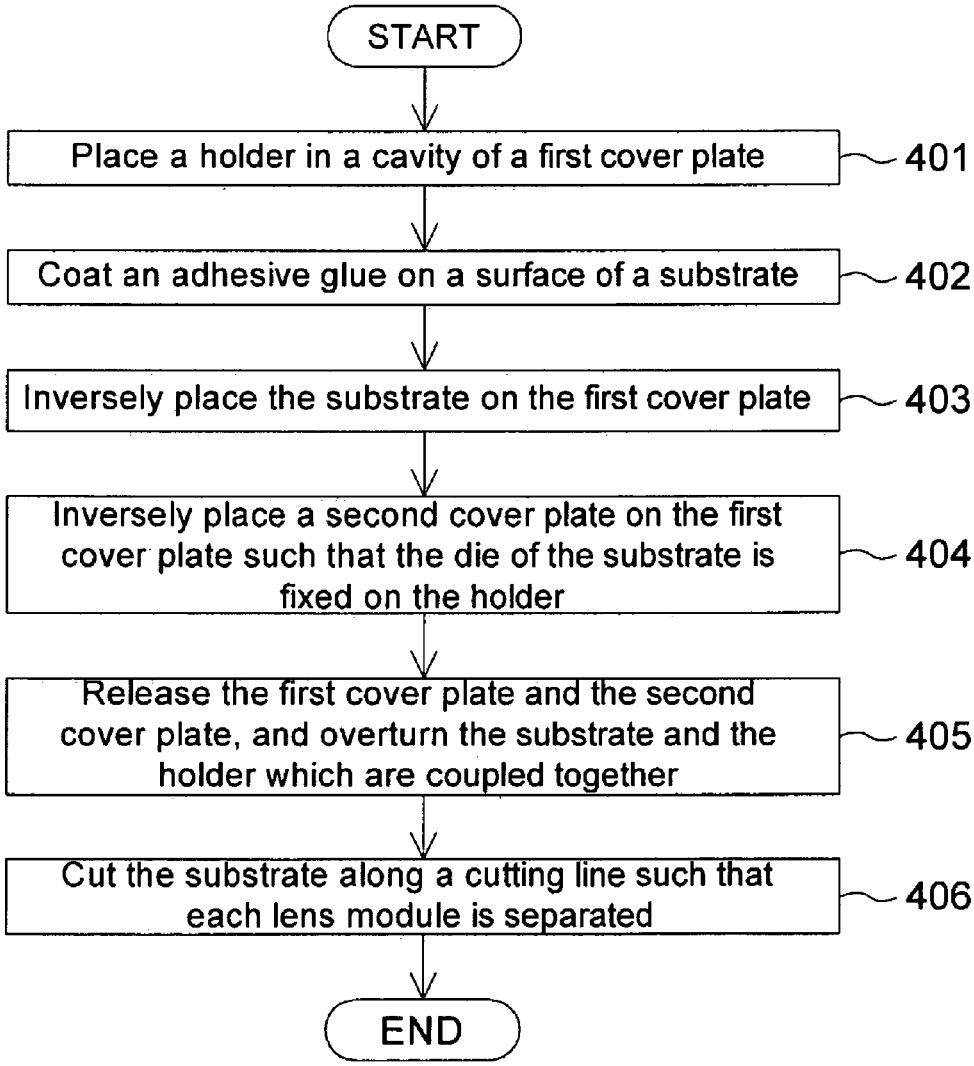
FIG. 4 shows a flowchart of a method for packaging lens module according to a first embodiment of the invention.

Next, the method for packaging the lens module is disclosed below. A flowchart of a method for packaging lens module according to a first embodiment of the invention as shown in FIG. 4 is elaborated by the following steps of the method.

Figure 5:
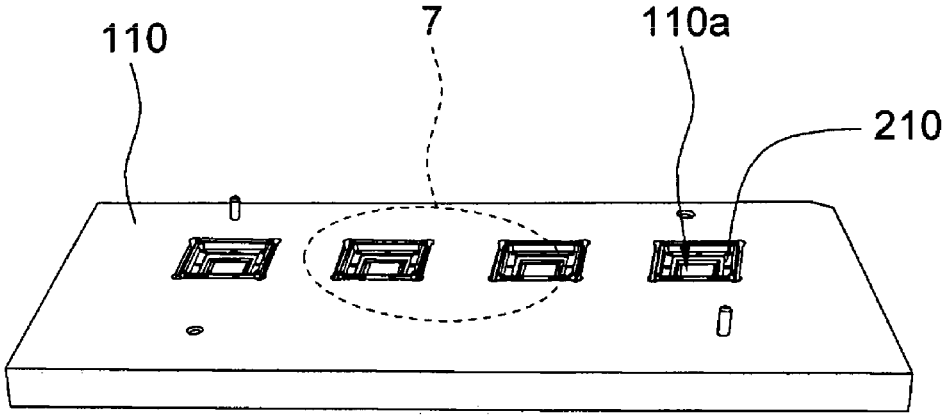
FIG. 5 shows a holder of FIG. 2 being placed in a cavity of a carrier.

Referring to both FIG. 2 and FIG. 5. FIG. 5 shows a holder of FIG. 2 being placed in a cavity of a carrier. Firstly, the packaging process begins at step 401. A holder 210 is placed in a cavity 110*a* of a carrier 110. In the present embodiment of the invention, the depth of the cavity 110*a* of the carrier 110 is substantially equal to the height of the holder 210, such that the holder 210 can be completely placed in the cavity 110*a*.

Next, again, referring to FIG. 3, and the packaging process proceeds to step 402. An adhesive glue 226 is coated on a surface 220*s* of a substrate 220, wherein the adhesive glue surrounds the die 222.

Figure 6:
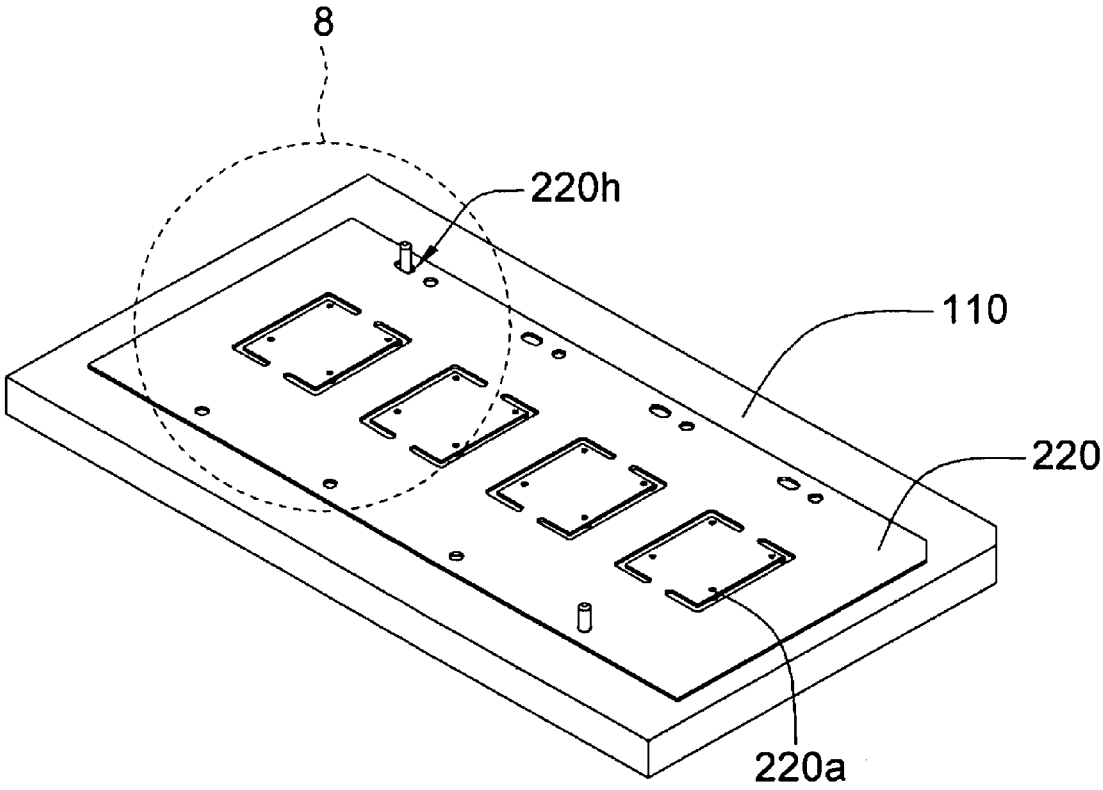
FIG. 6 shows a substrate being inversely placed on the carrier of FIG. 5

Referring to FIG. 6, a substrate being inversely placed on the carrier of FIG. 5 is shown. Then, the packaging process proceeds to step 403. The substrate 220 is inversely placed on the carrier 110, such that the surface 220*s* of the substrate 220 where the die 222 is disposed faces the carrier 110, and the die 222 corresponds to the holder 210.

Further referring to FIG. 2. The substrate 220 of the present embodiment of the invention preferably has several fixing holes 222*a* and several first fixing holes 220*h*, wherein the fixing holes 222*a* are surrounded by the cutting line L, and the first fixing holes 220*h* are disposed around the substrate 220 as indicated in FIG. 2.

Figure 7:
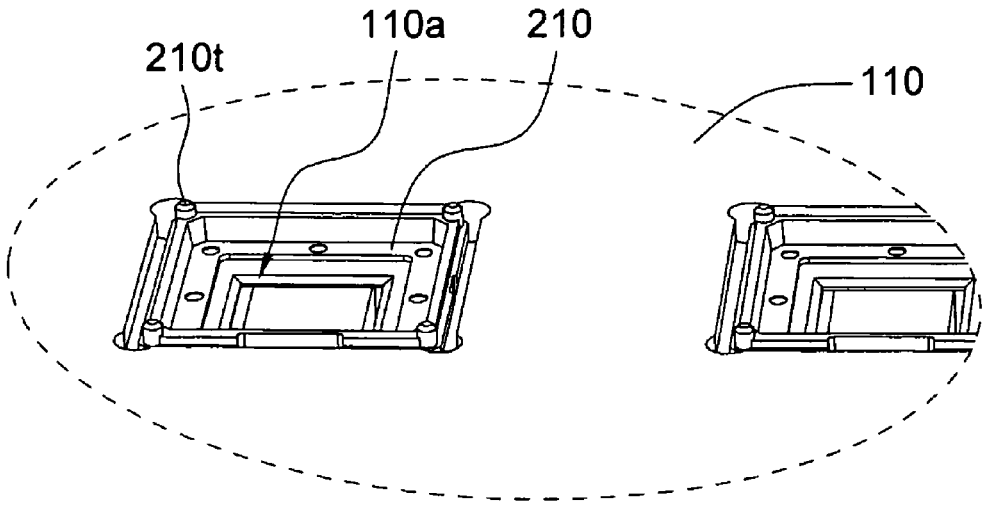
FIG. 7 shows a partial enlargement of FIG. 5 where the holder is placed on the carrier.
Figure 8:
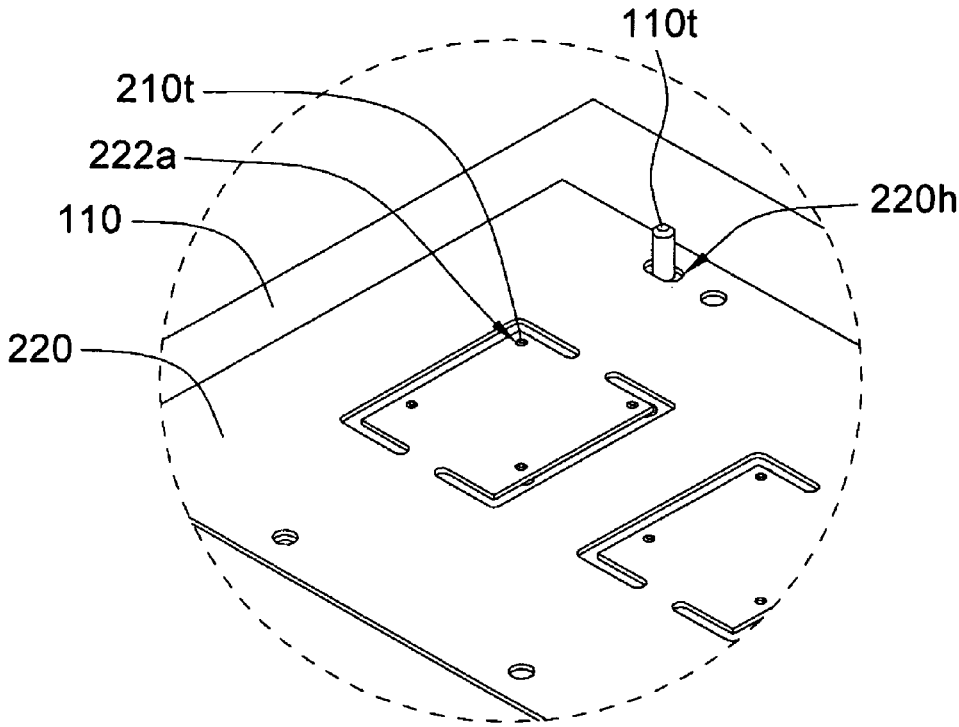
FIG. 8 shows a partial enlargement of FIG. 6 where the substrate is inversely placed on the carrier.

Referring to both FIG. 7 and FIG. 8. FIG. 7 shows a partial enlargement of FIG. 5 where the holder is placed on the carrier. FIG. 8 shows a partial enlargement of FIG. 6 where the substrate is inversely placed on the carrier. In the present embodiment of the invention, the holder 210 preferably includes several fixing columns 210*t*. After the holder 210 is placed in the cavity 110*a* of the carrier 110, several fixing columns 210*t* are protruded from the carrier 110, wherein the fixing columns 210*t* correspond to the fixing holes 222*a* of the substrate 220. Thus, when the substrate 220 is to be inversely placed on the carrier 110, the fixing columns 210*t* can be engaged with the fixing holes 222*a* of the substrate 220.

Moreover, the carrier 110 of the present embodiment of the invention preferably includes several fixing columns 110*t*, wherein the fixing columns 110*t* correspond to the first fixing holes 220*h* of the substrate 220. Thus, when the substrate 220 is inversely placed on the carrier 110, the first fixing holes 220*h* of the substrate 220 are engaged with the fixing columns 110*t* of the carrier 110, such that the substrate 220 is fixed on the carrier 110.

Next, referring to FIG. 2 again. In the present embodiment of the invention, the cover plate 120 has several second fixing holes 120*h*, the second fixing holes 120*h* correspond to the fixing columns 110*t* of the carrier 110.

Figure 9A:
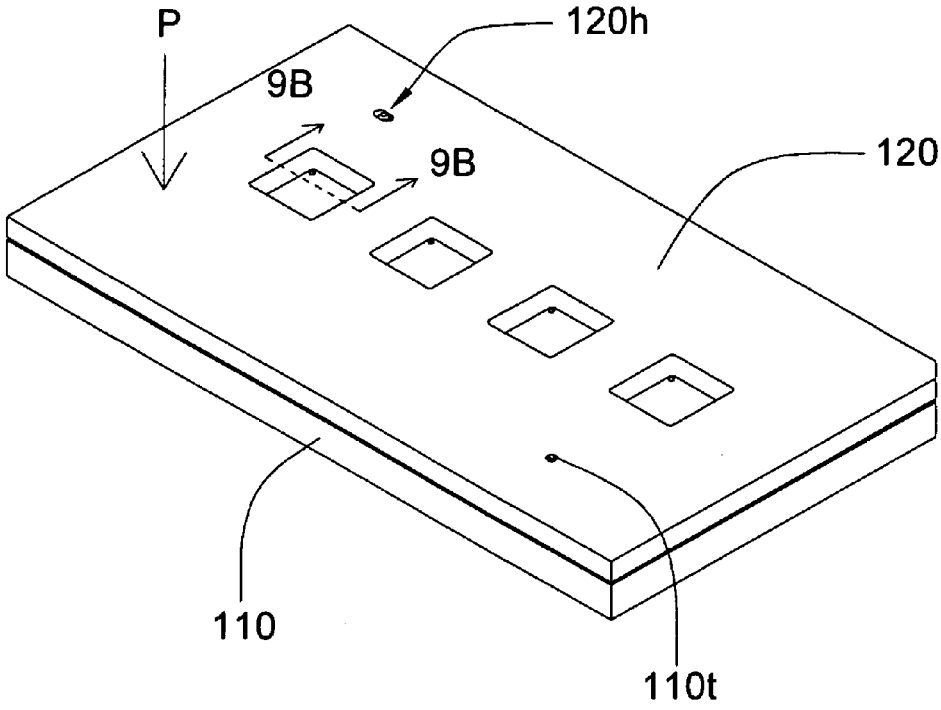
FIG. 9A shows a cover plate covering the carrier of FIG. 6.
Figure 9B:
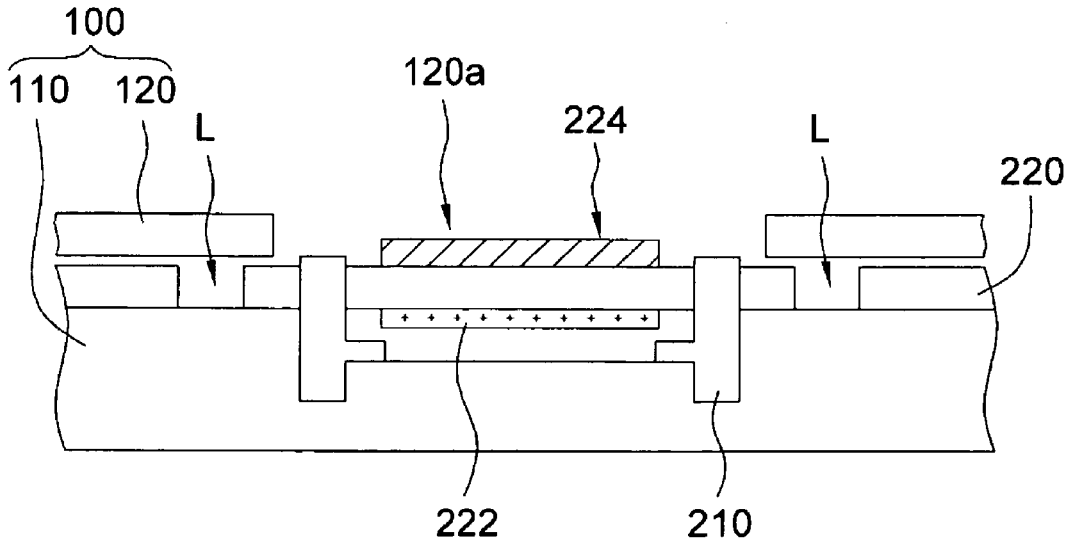
FIG. 9B shows a cross-sectional view of FIG. 9A along the cross-sectional line 9B-9B.

Next, referring to FIG. 9A and FIG. 9B. FIG. 9A shows a cover plate covering the carrier of FIG. 6. FIG. 9B shows a cross-sectional view of FIG. 9A along the cross-sectional line 9B-9B. The packaging process proceeds to step 404, the cover plate 120 covers the carrier 110, such that the substrate 220 is fixed on the holder 210. In FIG. 9A the substrate 220 and the holder 210 are already covered by the cover plate 120 and thus cannot be illustrated in FIG. 9A.

Referring to FIG. 9A, the cover plate 120 can be engaged with the fixing columns 110*t* via the second fixing holes 120*h*, such that the cover plate 120 is fixed on the carrier 110 and the substrate 220. In the process, a pressure P can be applied onto the cover plate 120, such that the substrate 220 and the holder 210 are adhered together by the adhesive glue 226 (shown in FIG. 3) of the substrate 220. Also, the substrate 220 and the holder 210 can be adhered together by way of applying pressure or heating.

As the opening 120*a* of the cover plate 120 is within the cutting line L and the element installation region 224 of the substrate 220, the cover plate 120 will not damage the element installation region 224 of the substrate 220, but will further apply a pressure onto the substrate 220.

Moreover, from step 403 to step 404, the surface 220*s* of the substrate 220 where the die 222 is disposed faces downward, hence avoiding being alighted by dust. When the substrate 220 is inversely placed on the carrier 110, the substrate 220 is assembled with several holders 210. Unlike the conventional packaging process which can only fix one holder 14 onto the substrate 10 at a time, the packaging process of the invention allows the holders 210 to be concurrently fixed on the substrate 220, not only saving manufacturing time but also resolving dust problem.

Figure 10:
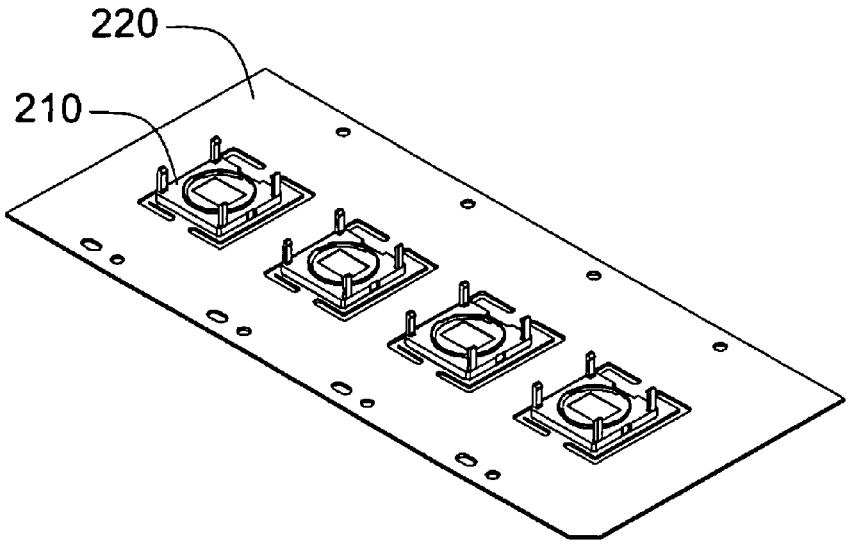
FIG. 10 shows a substrate released from the carrier and the cover plate.

Referring to FIG. 10, a substrate released from the carrier and the cover plate is shown. The packaging process proceeds to step 405. The carrier 110 and the cover plate 120 are released, and the substrate 220 and the holder 210 which are already coupled together are overturned.

Figure 11:
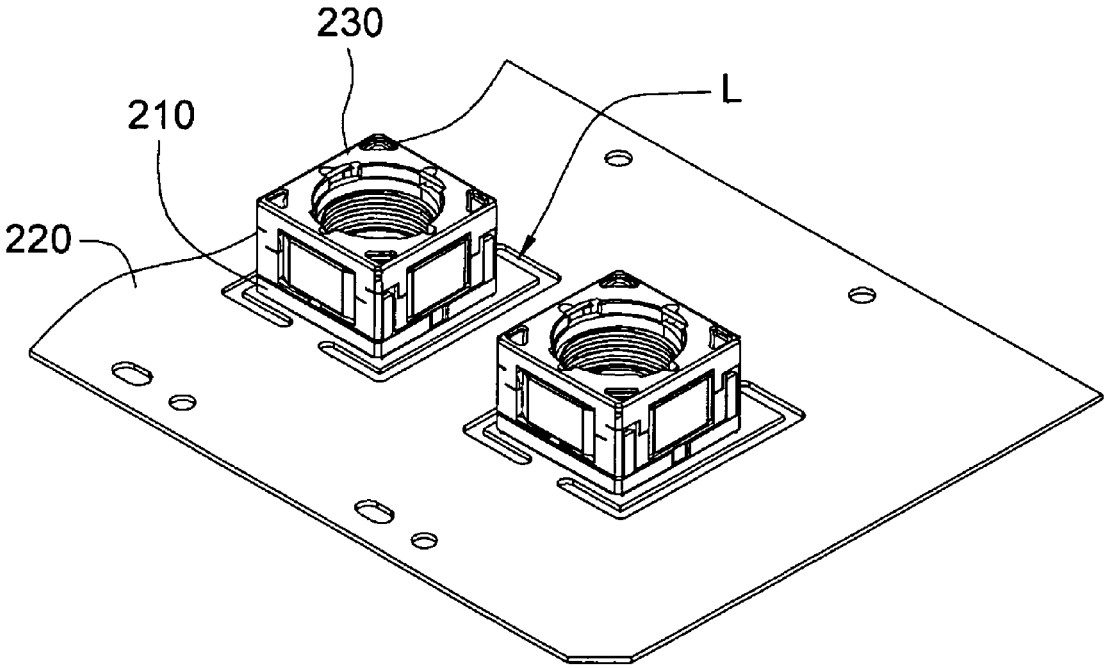
FIG. 11 shows a lens element installed in the holder.

Referring to FIG. 11, a lens element installed in the holder is shown. In the packaging process, a lens element 230 is installed on the holder 210.

Then, the packaging process proceeds to step 406. The substrate 220 is cut through along the cutting line L, such that each lens module is separated.

Second Embodiment

Figure 12:
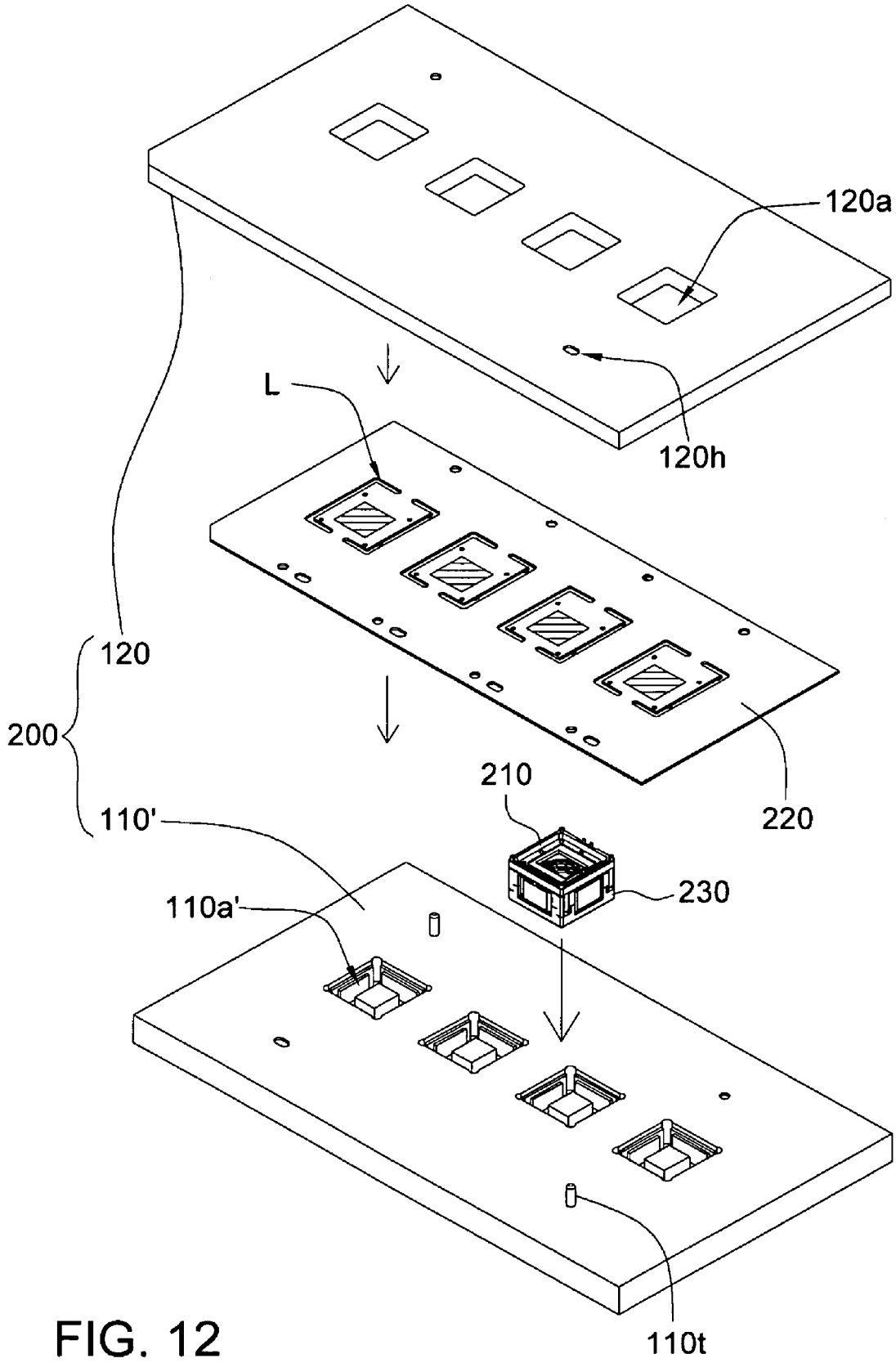
FIG. 12 shows a method for packaging lens module according to a second embodiment of the invention.

Referring to FIG. 12, a method for packaging lens module according to a second embodiment of the invention is shown. The method for packaging lens module of the second embodiment differs with the method for packaging lens module of the first embodiment in that a lens element 230 is placed in the holder 210 before the holder 210 is placed in the carrier 110', and other similarities are not repeated.

In the present embodiment of the invention, the tool 200 includes a carrier 110' and a cover plate 120. The carrier 110' has a cavity 110*a'* for receiving a lens element 230 and a holder 210 at the same time. The lens element 230 of the present embodiment of the invention can be placed in the cavity 110*a'* of the carrier 110' before the holder 210 is placed in the cavity 110*a*' of the carrier 110'. Next, the substrate 220 having a die 222 (shown in FIG. 3) is inversely placed on the carrier 110'. Then, the carrier 110' is covered by a cover plate 120. The holder 210 is fixed on the substrate 220 by way of applying pressure for example. Thus, the holder 210 and the lens element 230 are fixed on the substrate 220. Lastly, the packaging process proceeds to the cutting step where each of the lens modules 200 are separated along the cutting line L.

According to the tool and the method for packaging lens module disclosed in the above embodiments of the invention, with the disposition of the carrier and the cover plate, several holders are concurrently fixed on the substrate to save packaging time. In addition to that, the holder is fixed on the substrate with the substrate being inversely placed, hence avoiding dust from falling into the die sensing area.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A method for packaging lens module, the method comprising:

providing a carrier having at least one cavity;

placing a holder in the cavity;

disposing a die on a surface of a substrate; inversely placing the substrate on the carrier, wherein the surface of the substrate faces the carrier, and the die corresponds to the holder;

covering a cover plate on the carrier and the substrate, such that the substrate is fixed on the holder.

2. The method for packaging lens module according to claim 1, wherein the holder comprise a plurality of fixing columns, the substrate comprises a plurality of fixing holes, the fixing columns correspond to the fixing holes, and the step of inversely placing the substrate on the carrier comprises:

engaging the fixing holes with the fixing columns, such that the substrate and the holder are aligned.

3. The method for packaging lens module according to claim 1, wherein before the step of inversely placing the substrate on the carrier, the method further comprises:

coating an adhesive glue on the substrate and surrounding the die.

4. The method for packaging lens module according to claim 3, wherein the step of covering the cover plate comprises:

applying a pressure onto the cover plate, such that the substrate and the holder are adhered by the adhesive glue.

5. The method for packaging lens module according to claim 1, wherein the carrier comprise a plurality of fixing columns, the substrate comprises a plurality of first fixing holes, the fixing columns correspond to the first fixing holes, and the step of inversely placing the substrate comprises:

engaging the fixing columns with the first fixing holes of the substrate, such that the substrate is fixed on the carrier.

6. The method for packaging lens module according to claim 5, wherein the cover plate comprises a plurality of second fixing holes, the second fixing holes correspond to the fixing columns, and the step of covering the cover plate comprises:

engaging the fixing columns with the second fixing holes of the cover plate, such that the cover plate is fixed on the carrier and the substrate.

7. The method for packaging lens module according to claim 1, after the step of covering the cover plate, the method further comprises:

releasing the carrier and the cover plate and overturning the substrate and the holder which are coupled together; and installing a lens element on the holder.

8. The method for packaging lens module according to claim 1, wherein in the step of placing the holder in the cavity, a lens element is concurrently placed in the cavity.

* * * * *